US010357125B2

(12) United States Patent
Rahman

(10) Patent No.: US 10,357,125 B2
(45) **Date of Patent: *Jul. 23, 2019**

(54) DECORATIVE TREE

(71) Applicant: Sienna, LLC, Port St. Lucie, FL (US)

(72) Inventor: Najeh Rahman, Port St. Lucie, FL (US)

( * ) Notice: Subject to any disclaimer, the term of this patent is extended or adjusted under 35 U.S.C. 154(b) by 1077 days.

This patent is subject to a terminal disclaimer.

(21) Appl. No.: 14/736,986

(22) Filed: Jun. 11, 2015

(65) Prior Publication Data

US 2015/0320249 A1 Nov. 12, 2015

Related U.S. Application Data

(63) Continuation of application No. 14/518,519, filed on Oct. 20, 2014, now Pat. No. 9,055,835.

(Continued)

(51) Int. Cl.

| | |
|---|---|
| ***A47G 33/06*** | (2006.01) |
| ***A47G 33/08*** | (2006.01) |
| *F21W 121/04* | (2006.01) |

(52) U.S. Cl.

CPC ..... *A47G 33/06* (2013.01); *A47G 33/0845* (2013.01); *A47G 2033/0827* (2013.01); *F21W 2121/04* (2013.01); *Y10T 29/49828* (2015.01)

(58) Field of Classification Search

CPC ..... A47G 33/06; A47G 33/0845; A47G 2033/0827; A47G 33/04; A47G 33/045;

(Continued)

(56) References Cited

U.S. PATENT DOCUMENTS

| | | | |
|---|---|---|---|
| 430,970 | A | 6/1890 | Reed |
| D44,397 | S | 7/1913 | Berggren |

(Continued)

OTHER PUBLICATIONS

QVC.com; 4' Pre-Lit Collapsible Outdoor Christmas Tree with LED Lights, dated Sep. 22, 2014, Item No. H196668 http://www.qvc.com/.product.H196668.html?sc=H196668-ISRC.

(Continued)

*Primary Examiner* — Alan B Cariaso

(74) *Attorney, Agent, or Firm* — Amster, Rothstein & Ebenstein LLP

(57) ABSTRACT

A decorative tree comprises a base, a pole inserted in the base, and plural hoops that are pivotably connected in series prior to complete assembly of the tree. The lowest hoop is attached to the outer rim of the base, an uppermost hoop is provided to connect toward the top of the pole, and one or more intermediate hoops are interposed between the lowest and uppermost hoops. Each hoop has a pivotable connection to an adjacent hoop. The connection of a particular hoop to a lower adjacent hoop is formed on one side of the hoop and a connection of that particular hoop to an upper adjacent hoop is formed on a substantially opposite side of the hoop. Upon complete assembly of the tree, the uppermost hoop is extended toward the top of the tree and the hoops are expanded upward so as to form a decorative pattern of hoops with alternating angular orientations. The hoops may be of one or more shapes and sizes and may be wrapped with light strips to illuminate the tree.

33 Claims, 9 Drawing Sheets

Related U.S. Application Data

(60) Provisional application No. 61/942,849, filed on Feb. 21, 2014.

(58) Field of Classification Search
CPC ..... Y10T 29/49828; F21S 4/10; F21S 4/003; F21S 4/001; F21W 2121/00; F21W 2121/004; F21W 2121/04; F21V 19/0005
USPC ..... 362/249.18, 249.19, 123
See application file for complete search history.

(56) References Cited

U.S. PATENT DOCUMENTS 2,731,752 A * 1/1956 Erickson ..... A47F 11/00 362/123
D179,349 S 12/1956 Johnson
D182,663 S 4/1958 Hovlid
D182,664 S 4/1958 Hovlid
D182,665 S 4/1958 Hovlid
D182,666 S 4/1958 Hovlid
2,841,901 A 7/1958 Maple
D200,052 S 1/1965 Haas
3,674,612 A 7/1972 Gehl, Jr.
3,677,867 A 7/1972 Westlund
3,704,366 A 11/1972 Korb et al.
3,970,834 A 7/1976 Smith
4,121,720 A * 10/1978 Hayes ..... A47F 5/0892 211/113
D250,519 S 12/1978 Hashimoto
4,331,720 A 5/1982 Vin Dick et al.
D269,771 S 7/1983 Williams
D276,322 S 11/1984 Maxwell et al.
4,746,022 A * 5/1988 Benham ..... A47F 5/04 211/195
4,748,058 A 5/1988 Craig, Jr.
4,968,541 A 11/1990 McCrory
4,968,547 A * 11/1990 McCarthy ..... B42D 15/006 428/194
5,106,661 A 4/1992 Pitts, Sr.
D347,598 S 6/1994 Maddox, Jr.
5,336,536 A 8/1994 Oberzan
5,405,662 A 4/1995 Oberzan
5,413,825 A 5/1995 Chaikin
D408,319 S 4/1999 Byers
6,048,590 A 4/2000 Phillips
6,062,701 A 5/2000 Hines
6,132,063 A 10/2000 Byers
6,139,168 A 10/2000 Gary et al.
D442,115 S 5/2001 Tsang
6,247,991 B1 6/2001 Chen
6,254,250 B1 7/2001 Shieh
6,334,694 B1 1/2002 Huang
6,379,021 B1 4/2002 Shieh
6,458,435 B1 10/2002 Lai
D478,021 S 8/2003 Duncan, Jr. et al.
6,652,927 B1 11/2003 Chen
6,679,622 B1 1/2004 Kao
7,011,427 B1 * 3/2006 Baez ..... G08B 5/004 362/184
7,144,610 B1 12/2006 Estes et al.
7,152,998 B2 12/2006 Rahman
7,445,823 B2 11/2008 Tennison
D612,286 S 3/2010 Palmer et al.
D638,742 S 5/2011 Purcell
D668,174 S 10/2012 Bliss
2005/0048226 A1 3/2005 Gary et al.

OTHER PUBLICATIONS

QVC.com; Pre-Lit 5' Fold Flat Outdoor Christmas Tree, by Lori Greiner; dated Sep. 22, 2014, Item No. H200762 http://www.qvc.com/Pre-Lit-5-Fold-Flat-Outdoor-Christmas-Tree-by-Lori-Greiner.product.H200762.html?sc=H200762-SRCH&cm_sp=VIEWPOSITION-_-4-_-H200762&catentryImage=http://images.qvc.com/is/image/h/62/h200762.001?$uslarge$.
Lamp Design Ideas; Collapsible Christmas Tree with Lights, dated Sep. 22, 2014 http://fsldk.org/collapsible-christmas-tree-with-lights/.

* cited by examiner

DECORATIVE TREE

CROSS-REFERENCE TO RELATED APPLICATION

This application is a continuation of and claims the benefit of U.S. patent application Ser. No. 14/518,519 filed Oct. 20, 2014 and entitled "Decorative Tree", and claims the benefit of U.S. provisional application Ser. No. 61/942,849 filed Feb. 21, 2014 and entitled "Decorative Tree," both of which are incorporated herein by reference.

FIELD OF THE INVENTION

The present invention relates to a collapsible decorative tree that is easy to assemble and disassemble.

BACKGROUND OF THE INVENTION

A traditional Christmas tree, in its basic form, has the outline of an upright cone or in some instances an upright cone which has been truncated at the top. Artificial Christmas trees often take this traditional shape. However, there is also a market for non-traditional decorative trees that can be displayed during the Christmas season to enhance the holiday spirit.

In addition to offering a pleasant aesthetic, it is important that a decorative tree be easy for consumers to assemble and disassemble for storage and easy to maintain. It is likewise important that the trees be easy to package and ship by manufacturers and distributors.

Accordingly, it is an object of the present invention to provide a decorative tree that is aesthetically pleasing as well as easy to assemble and disassemble.

SUMMARY OF THE INVENTION

A decorative tree is constructed of a base and a central support tube (pole) extending vertically from the base. The base can be any shape but is preferably circular.

In an embodiment, the decorative tree is further comprised of a plurality of hoops which extend from the base to the top of the support tube. The plurality of hoops are pivotably connected to each other and generally extend substantially from the base to the top of the central support tube. The first hoop is connected to the base at a single connection along the periphery of the base. The first hoop is also pivotably connected to the second hoop at a single connection along the periphery of both hoops where the hoops contact each other. In a preferred embodiment, the connection between the first hoop and the second hoop is approximately 180° around the periphery (for circular or oval hoops) or substantially on the opposite side of the first hoop from the connection with the base. The third hoop is pivotably connected to the second hoop substantially on the opposite side from the connection between the first and second hoops, and the fourth hoop is connected to the third hoop along the periphery of the third hoop at a point substantially above the connection for the first and second hoops. Successive hoops are pivotably connected similarly so that when the periphery of the topmost hoop is gripped approximately at an opposite side from the connection with the immediately adjacent hoop and pulled upwardly, the plurality of hoops will all be pivotably connected together at a single connection on each adjacent hoop. It is possible that successive connections will be more or less than 180°, or not substantially opposite, from the previous point in order to create other decorative appearances.

The hoops are generally planar objects that fit around the central support tube with clearance to enable movement of the hoops relative to the central support tube. For example, the hoops can be circular, triangular, square, rectangular, snowflake-shaped, shaped as an animal, or any given shape. Further, adjacent hoops can have different shapes. Successive hoops can be the same size or different sizes.

In embodiments, a connection between hoops may include a single connecting point. However, in other embodiments, the tree may include a pivotable connection between two adjacent hoops that includes two or more connecting points in proximity to one another that form as single axis of rotation. Thus, for example, when the hoops are snowflake-shaped with multiple branches arrayed around a hub, a connection may include a connecting point on each of two adjacent branches.

In an embodiment, when it is desired that the decorative tree give the appearance of a Christmas tree, for example, otherwise conventional light strings of incandescent bulbs or LEDs can be mounted to the hoops and extend from the bottom or base of the tree up to the top of the central support tube to illuminate the tree.

When the tree is used as a Christmas tree, it can include a star, angel or other decoration on the top of the central support tube. The decoration can be lighted if desired.

It is also advantageous to reinforce the decorative tree. Thus, in an embodiment, a monofilament line or other similar string-like materials are fastened to the base portion and extend to the topmost hoop. The monofilament line may be fastened to each hoop or to selected hoops. Preferably, two or more monofilament lines are used to provide stability.

The construction of the decorative tree of the present invention enables the tree to assume a compact orientation for storage.

BRIEF DESCRIPTION OF THE DRAWINGS

The above and related objects of the present invention will be more fully understood by reference to the following detailed description of the presently preferred, albeit illustrative, embodiments of the present invention when taken in conjunction with the accompanying drawings wherein.

DETAILED DESCRIPTION OF THE PREFERRED EMBODIMENTS

Figure 1B:
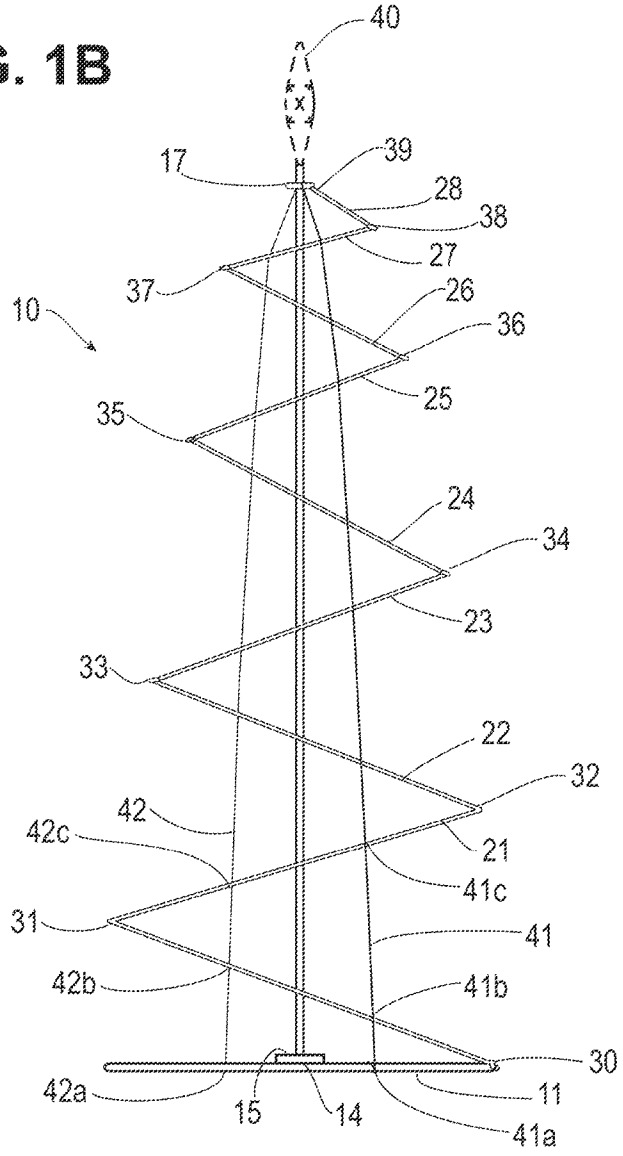
FIG. 1B is a side elevational view of the decorative tree of FIG. 1A.
Figure 1A:
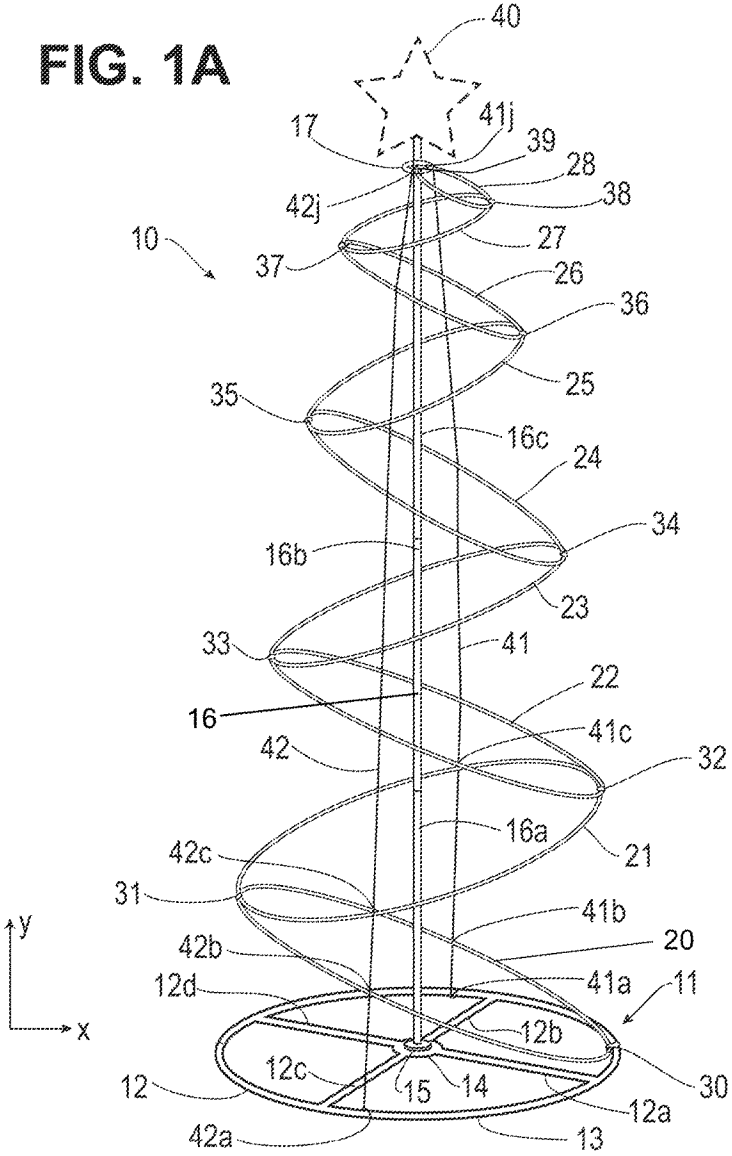
FIG. 1A is an isometric view of a first embodiment of a decorative tree with connected curvilinear hoops according to the present invention after complete assembly thereof.

Referring now to the drawings, and in particular to FIG. 1A thereof, a decorative tree 10 in a first embodiment of the present invention is illustrated. After complete assembly of the tree, as shown in FIG. 1A, the tree is generally designated by the reference numeral 10.

In the embodiment of FIG. 1A, the tree 10 comprises a substantially planar or flat wheel-like base 11 and a central support tube 16 (or pole) extending vertically from the base. Base 11 may be any shape but is preferably circular. In an embodiment, base 11 includes an outer rim 13, a base hub 14 at the center of base 11, and hub connector means 12 to connect outer rim 13 to base hub 14. Hub connector means 12 may be any style of connectors that provide a sturdy support for base hub 14. For example, hub connector means may comprise one or more circumferentially-spaced spokes or links 12*a*, 12*b*, 12*c*, 12*d* that radially connect outer rim 13 and base hub 14. Alternatively, each connection means 12 may be of a helical or spiral design connecting outer rim 13 and base hub 14. Moreover, while outer rim 13 is preferably generally circular, the rim may in fact be polygonal or irregular in nature. In another embodiment, the base may be made as a unitary component with accommodation for a base hub.

Central support tube 16 (or pole) is designed to be releasably attached at the bottom of the tube to base hub 14 as described below. When attached, the base 11 and the central support tube 16 provide an upright structure for the tree. At or near the top of central support tube 16 is a hanger 17 which can connect an uppermost hoop (see below) to the central support tube. Hanger 17 may be packaged as pre-connected to the uppermost hoop and may include a wheel-like hub means which is rigid and constructed and arranged to slip over the central support tube to connect the uppermost hoop to central support tube 16. Alternately, hanger 17 may be formed at a top part of tube 16.

Central support tube 16 can be formed of a single segment or two or more segments (see FIG. 4) which are configured and dimensioned to be removably assembled in an end-to-end relationship to form a central support tube 16 of appropriate height. Alternatively, where the central support tube 16 is formed from multiple segments, the segments may slip into each other in a telescopic arrangement. Those skilled in the mechanical arts will readily appreciate how the various segments may be combined to form a single pole and how the ends of the pole may be releasably connected to base hub 14. By way of example only, a short vertical downward extension of hanger 17 fits over and receives therein an upper end of a top pole segment 16*c*, while the bottom end of segment 16*c* fits over and receives the upper end of the next lower segment 16*b*, etc. until the bottom end of the bottom segment 16*a* fits over and over and receives therein a short vertical upward extension of base hub 14.

The tree 10 is further comprised of a plurality of hoops 20 to 28 which are connected to each other and, when the tree is assembled, extend substantially from base 11 to the top of central support tube 16. (It should be understood that the hoops need not be connected only to the top of the central support tube but may be connected toward the top, which would include a connection to the top of the tree or a point below the top of the tree.) In the embodiment shown in FIG. 1A, nine connected hoops are shown as an example. However, the number of hoops included for any particular tree, according to the present invention, may vary depending on the height of the tree and the appearance to be achieved. For example, there may be only three hoops, including a first, lowermost hoop connected to base 11, a second, uppermost hoop connected toward the top of central support tube 16, and a hoop intermediate the lowermost and uppermost hoops.

As used herein, the terms "connecting point" or "connection" between hoops is used to refer to a pivotable connection. It does not refer to possible use of wrapping a monofilament to prevent the central support tube 16 from bending relative to the base 11 of an assembled decorative tree.

In the first embodiment, the first hoop 20 is pivotably connected to the base 11 at a single connecting point 30 (a "connection" may be formed by one or more connecting points) along the periphery or "edge" (which, in this case, is outer rim 13) of the base. The first hoop 20 is also pivotably connected to the second hoop 21 at a single connecting point 31 along the periphery (or "edge") of both hoops 20, 21. In a preferred embodiment, the connecting point 31 between the first hoop 20 and the second hoop 21 may be approximately 180° around the periphery or on the opposite side of the first hoop 20 from the connecting point 30 with the base. The third hoop 22 is pivotably connected to the second hoop 21 at a connecting point 32 which is approximately 180° from the connecting point 31 between the first and second hoops 20, 21, and the fourth hoop 23 is pivotably connected to the third hoop 22 along the periphery of the third hoop 22 at a connection point 33 which is substantially above the connecting point 31 for the first and second hoops 20, 21. Successive hoops 24 to 28 are similarly pivotably connected with respective connecting points 34 to 38. Thus, when the periphery of the topmost hoop 28 is gripped approximately 180° from the connecting point 38 with the immediately adjacent hoop 27 and pulled upwardly, the plurality of hoops will all be connected together in series at a single connecting point between each adjacent hoop.

Notably, with a series of hoops connected in this manner, while a particular hoop intermediate the lowermost and uppermost hoop is connected to adjacent hoops, the hoops adjacent the intermediate hoop are not directly connected. For example, hoop 21 is connected to adjacent hoops 20 and 22. However, there is no direct connection between hoops 20 and 22.

Non-limiting examples of different styles of connectors at the connecting points between hoops are shown and described below in connection with FIGS. 6A, 6B, and 6C. The connection between the uppermost hoop and the upper hanger 17 of central support tube 16 may comprise a plastic zip tie. It is possible that successive connecting points will be somewhat more or less than 180° from the previous point in order to create other decorative appearances. For example, adjacent hoops can be connected at 120° to cause the plurality of hoops to form a tree having a somewhat spiral appearance.

When tree 10 is completely assembled, the hoops pivot about the respective connecting points so that the hoops are angled relative to one another in a pattern of alternating orientations from the base to the top of the tree. The degree of the angles between the hoops may vary based on the desired design, the number, dimensions and shapes of the hoops used and the height of the tree 10, among other things.

The pattern of alternating orientations of the hoops can be understood with reference to the perspective view of FIG. 1A. In this figure, first hoop 20 is illustrated as pivoted about connecting point 30 in an upward, clockwise direction relative to base 11 and forming an obtuse angle relative to the x-axis. In contrast, the adjacent, second hoop 21 is pivoted upward in a counterclockwise direction and forms an acute angle with the x-axis. This pattern of alternating orientations continues through the uppermost hoop of FIG. 1A.

As used herein, the term "hoop," unless a specific shape is mentioned, refers generally to an object, such as an object formed as a loop (generally, but not necessarily, fully closed), a conventional hoop, an annulus, or a thick or thin disk, that generally takes a planar shape and fits around the central support tube with clearance to enable movement relative to the central support tube. The hoops need not be planar. In the case of a disk, a center opening is needed to allow for the requisite clearance. The shape of the object may be, for example, a geometric shape or another generally planar shape. For example, the object may be circular (as shown in FIG. 1A), oval, triangular, square, rectangular, or polygonal or may be shaped as a snowflake, a star, or an animal, or may have any other desired shape. See, e.g., FIGS. 2A, 3A, 3B, 3C, 3D, and 5. Further, adjacent hoops can have different shapes. The various hoops can alternatively be formed in different shapes and, for example, if the "hoops" are made to look like an animal, they can appear to be topiary when viewed from a distance. Other hoops may have portions extending higher or lower than the general surface of the hoop.

Successive hoops can be the same size or different sizes. In the preferred embodiment of FIG. 1A, the adjacent hoops are shown as being progressively smaller in radius from the bottom to the top of the tree 10.

The hoops are generally formed of a substantially rigid material such as a rigid metal wire, rigid plastic, Plexiglass, Lucite, or wood, to name a few, so as to maintain the desired shapes of the hoops when assembled and disassembled. The hoops may be, for example, transparent, translucent, or opaque.

When the decorative tree is used as a Christmas tree, for example, conventional light strings of incandescent bulbs or LEDs can be mounted to the hoops and extend from the bottom or base of the tree up to the top of the central support tube. Each light string contains a plurality of miniature or midget lamps and may include flashing sets or twinkle bulbs. The light strings are not illustrated in FIG. 1A so that one skilled in the art can better appreciate the underlying structure of tree 10 according to a present invention. However, the light strings are illustrated and described with reference to the embodiment shown in FIG. 5 and thereafter.

When tree 10 is used as a Christmas tree, it can include a decorative tree topper 40, such as a star, angel or other decoration on the top of the central support tube 16. This is shown in phantom in FIG. 1A. The decoration can be lighted if desired.

In order to utilize the thinnest, lightest weight materials to fabricate base 11 and the central support tube 16, it is advantageous to reinforce the decorative tree 10 utilizing one or more monofilament lines or other similar string-like materials which are fastened to the base portion 11 at 41*a*, 42*a* and extend to the hanger 17 connected to the uppermost hoop 28. Preferably, two or more monofilament lines are used to provide stability. Monofilament line is particularly advantageous because it has some degree of stretch, is somewhat translucent and is relatively strong; however, other string or rope may be used.

Two monofilament lines 41, 42 are shown in the embodiment of FIG. 1A. Each of the lines may be fastened to each hoop at respective points along the path of each line where the monofilament lines 41, 42 contacts the hoops, when the tree is completely assembled, or each of lines 41, 42 may be fastened only to a selected hoop or hoops. Referring to FIG. 1A, as but one example, monofilament line 41 is shown as being fastened at least to base 11 at point 41*a*, to hoop 20 at point 41*b*, to hoop 21 at point 41*c*, and to hanger 17 at point 41*j*. Similarly, monofilament line 42 is shown as being fastened at least to base 11 at point 42*a*, to hoop 20 at point 42*b*, to hoop 21 at point 42*c*, and to hanger 17 at point 42*j*. Each of lines 41, 42 may be attached to each of the other hoops 22 to 28. When the decorative tree 10 is completely assembled, the tension provided by the two or more monofilament lines will prevent the central support tube 16 from bending relative to the base 11. It is not necessary to use the monofilament lines when a strong base and supporting tube are used.

As noted above, the uppermost hoop may be attached to a wheel-like hub means, such as hanger 17, which is rigid and constructed and arranged to slip over the central support tube. As shown in FIG. 1A, the monofilament lines can be connected to hanger 17, which provides stability once the hub is slipped over the top of the central support tube. A stop means either in the hub or on the central support tube maintains the monofilament lines in tension.

When used outdoors or in locations where the tree 10 may be accidentally bumped into, it is preferable to fasten the base to the ground, using stakes outdoors or tape or other means, if indoors.

Figure 1D:
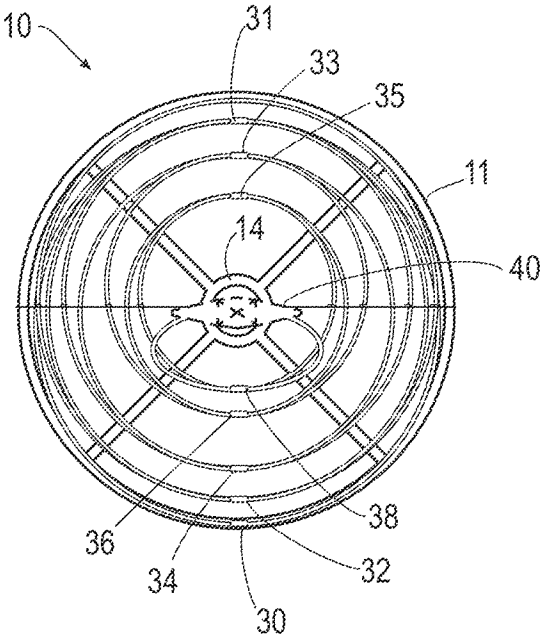
FIG. 1D is a top view of the decorative tree of FIG. 1A.
Figure 1C:
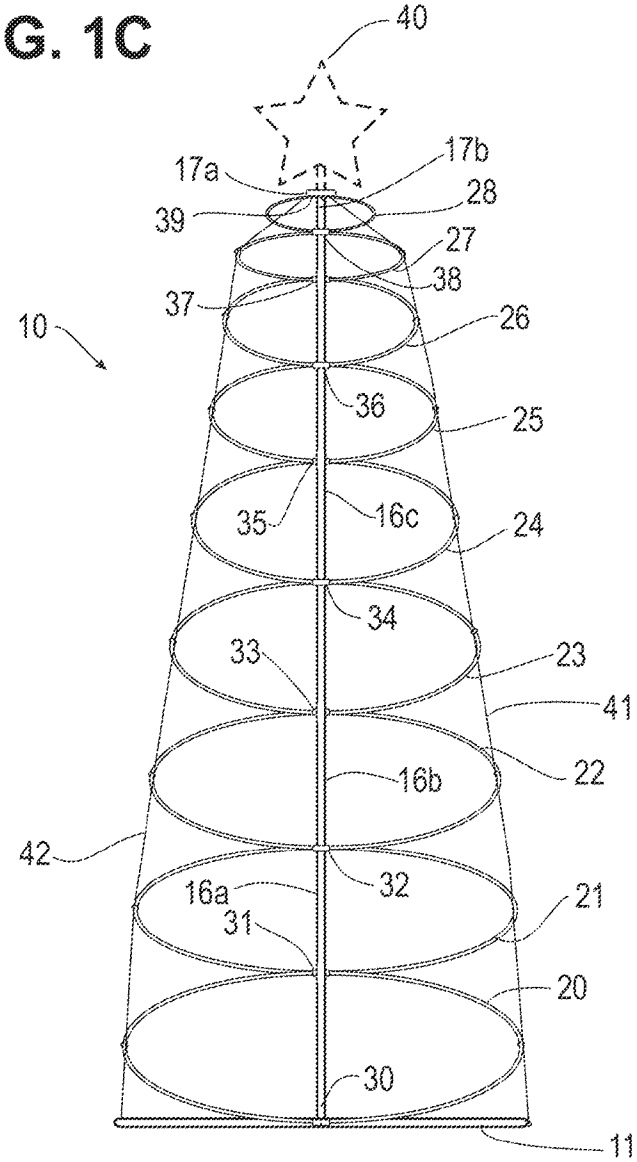
FIG. 1C is a front elevational view of the decorative tree of FIG. 1A.

FIGS. 1B, 1C, and 1D are respectively side elevational, front elevational and top views of the first embodiment of the decorative tree as shown in FIG. 1A. As such, corresponding elements to those shown FIG. 1A are identically labeled.

Figure 2B:
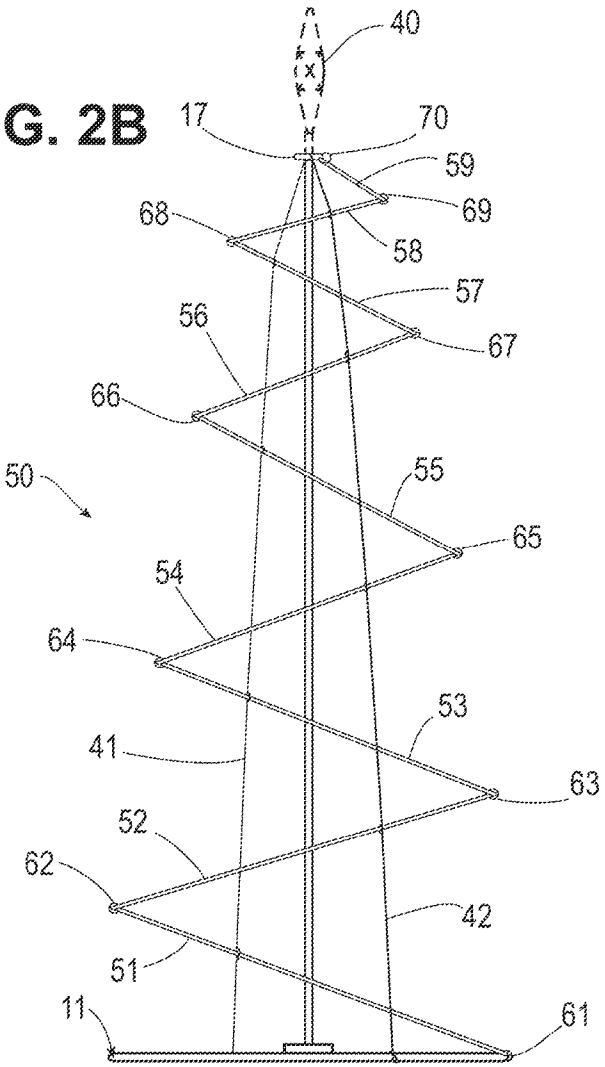
FIG. 2B is a side elevational view of the decorative tree of FIG. 2A.
Figure 2A:
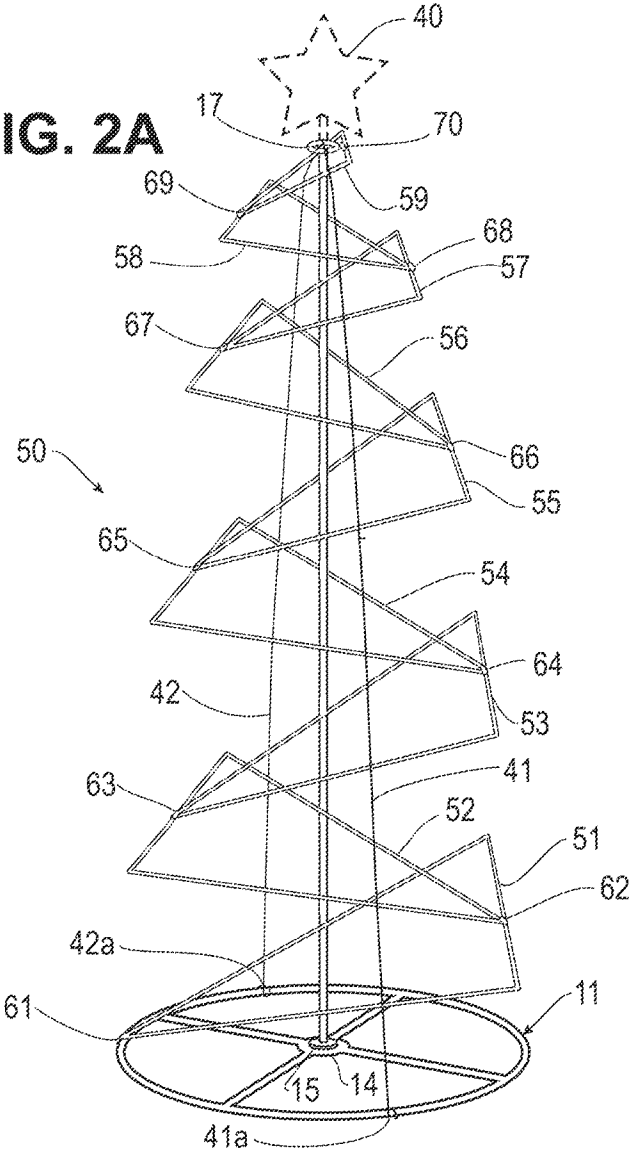
FIG. 2A is an isometric view of a second embodiment of a decorative tree with connected triangular shaped hoops according to the present invention after complete assembly thereof.

FIG. 2A shows a second, alternate embodiment of a decorative tree 50 of the present invention after complete assembly thereof. In this second embodiment, the tree 50 has a series of connected triangular-shaped hoops 51 to 59 that, when tree 50 is assembled, extend substantially from base 11 to the top of central support tube 16. In the illustrated embodiment, the triangular hoops are shown, for example, as oriented downward at angles of declination relative to a horizontal position. Moreover, in the embodiment shown in FIG. 2A, nine triangular hoops are shown as an example. However, the number of hoops included for any particular tree, according to the present invention, may vary depending on the height of the tree and the appearance to be achieved.

As in the first embodiment, tree 50 may comprise a base 11 and a central support tube 16 extending vertically from the base 11 and designed to be releasably attached to base 11. FIG. 2A shows a substantially planar or flat wheel-like base 11 as in the first embodiment. However, one skilled in the art will understand that base 11 may be constructed in one of various alternative configurations, such as the variations described above with reference to FIG. 1A. Likewise, central support tube 16 may be constructed in one of various alternative configurations, some of which are described above.

Further referring to FIG. 2A, a first triangular hoop 51 may be pivotably connected to outer rim 13 of base 11 at a first connecting point 61 at a single vertex of triangular-shaped hoop 51. First hoop 51 is also pivotably connected to a second triangular hoop 52 at a second connecting point 62 at a periphery or "edge" of both hoops 51, 52 where the hoops 51, 52 contact or are in close proximity to each other. In a preferred embodiment, the connecting point 61 between the first hoop 51 and the second hoop 52 may be approximately on the opposite side of the first hoop 51 from the connecting point 61 with the base 11. As an example, second connecting point 62 may be substantially located at a vertex (or apex) of triangular-shaped hoop 52 and located along a side (base) of the triangle of first hoop 51 substantially opposite connecting point 61. Thus, first connecting point 61 may be located at the apex of the triangular hoop 51 and second connecting point 62 may be located at approximately the middle of the base of the hoop 51 and at the apex of hoop 52.

The hoops 52 to 59 in the second embodiment may be similarly connected. For instance, as illustrated, hoop 52 is pivotably connected along a side thereof to a vertex of adjacent hoop 53 at connecting point 63 that is approximately opposite to connecting point 62. Hoop 53 is pivotably connected along a side thereof to adjacent hoop 54 at connecting point 64 that is approximately opposite to connecting point 63. Hoop 54 is pivotably connected along a side thereof to adjacent hoop 55 at connecting point 65 that is approximately opposite to connecting point 64. Hoop 55 is pivotably connected along a side thereof to adjacent hoop 56 at connecting point 66 that is approximately opposite to connecting point 65. Hoop 56 is pivotably connected along a side thereof to adjacent hoop 57 at connecting point 67 that is approximately opposite to connecting point 66. Hoop 57 is pivotably connected along a side thereof to adjacent hoop 58 at connecting point 68 that is approximately opposite to connecting point 67. And hoop 58 is pivotably connected along a side thereof to adjacent hoop 59 at connecting point 69 that is approximately opposite to connecting point 68. Hoop 59 is connected to hanger 17 sitting atop central support tube 16 at connecting point 70 opposite to connecting point 69.

Thus, in this second embodiment, successive hoops 51 to 59 may be connected such that when the periphery of the topmost hoop 59 is gripped approximately opposite the connecting point 69 with the immediately adjacent hoop 58 and pulled upwardly, the plurality of hoops 51 to 59 will be connected together in series at a single connecting point between each adjacent hoop.

One skilled in the art will understand that, for a particular hoop in this second embodiment, the connecting points to adjacent hoops need not be on a vertex of a triangle or at the center of the base. Variations on the assembled appearance of tree 50 can be achieved by somewhat varying the positioning of the connecting points on each hoop or by connecting apices or bases together.

As with the first embodiment, one or more monofilament lines or other similar string-like materials which are fastened to the base portion 11 at 41*a*, 42*a* and extend to the hanger 17 above the topmost hoop 59. Two monofilament lines 41, 42 are shown in the embodiment of FIG. 2A. Each of the lines may be fastened to each hoop at respective points along the path of each line where the monofilament lines 41, 42 contacts the hoops when the tree is completely assembled or each of lines 41, 42 may be fastened only to a selected hoop or hoops.

While hoops 51 to 59 are illustrated as being similar in shape, adjacent hoops can have also different shapes with some being triangular and other hoops being of a different shape. Successive hoops can be the same size or different sizes. In the preferred embodiment of FIG. 2A, the adjacent hoops are shown as being progressively smaller in size from the bottom to the top of the tree 10. However, the size of adjacent hoops may be randomly arranged.

When the decorative tree 50 is used as a Christmas tree, for example, one or more conventional light strings of incandescent bulbs or LEDs can be mounted to the hoops and extend from the bottom or base of the tree up to the top of the central support tube. The light strings are not illustrated in FIG. 2A so that one skilled in the art can better appreciate the underlying structure of tree 50 according to a present invention. However, the light strings are illustrated and described with reference to the embodiment shown in FIG. 5.

When tree 50 is used as a Christmas tree, it can include a decorative tree topper 40, such as a star, angel or other decoration on the top of the central support tube 16. The decoration can be lighted if desired.

Figure 2D:
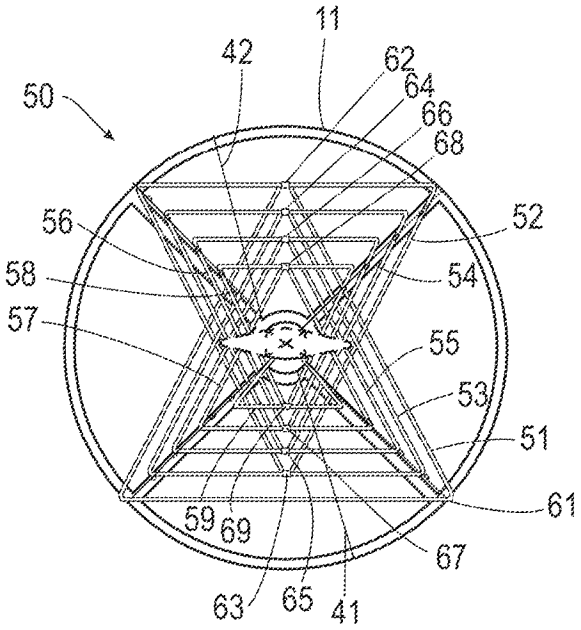
FIG. 2D is a top view of the decorative tree of FIG. 2A.
Figure 2C:
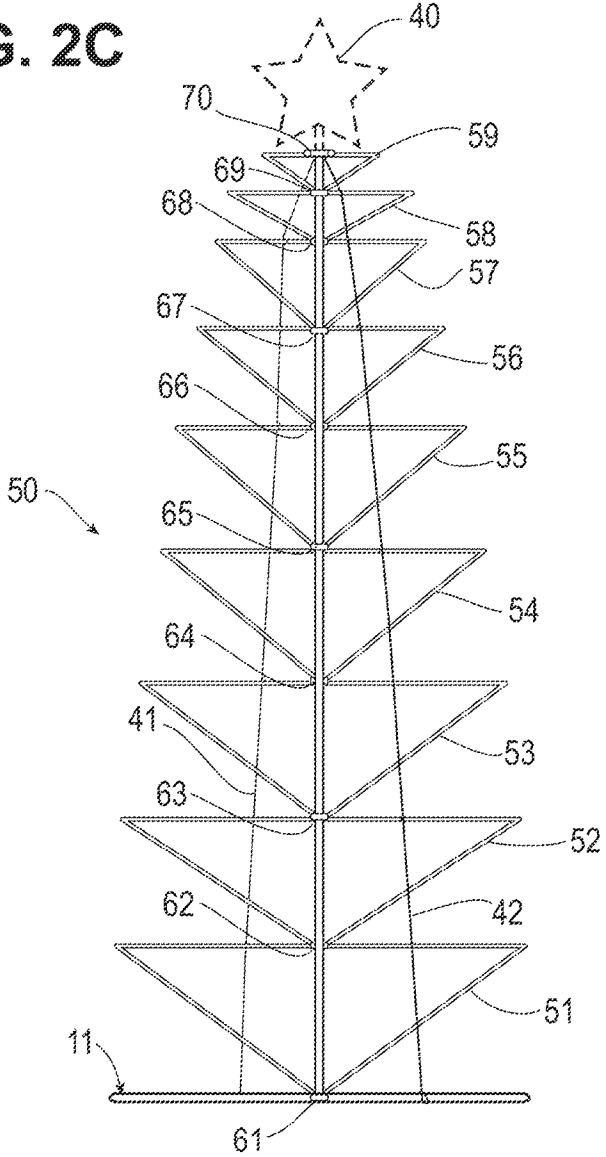
FIG. 2C is a front elevational view of the decorative tree of FIG. 2A.

FIGS. 2B, 2C, and 2D are respectively side elevational, front elevational and top views of the second embodiment of the decorative tree as shown in FIG. 2A. As such, corresponding elements to those shown FIG. 2A are identically labeled.

Figure 3B:
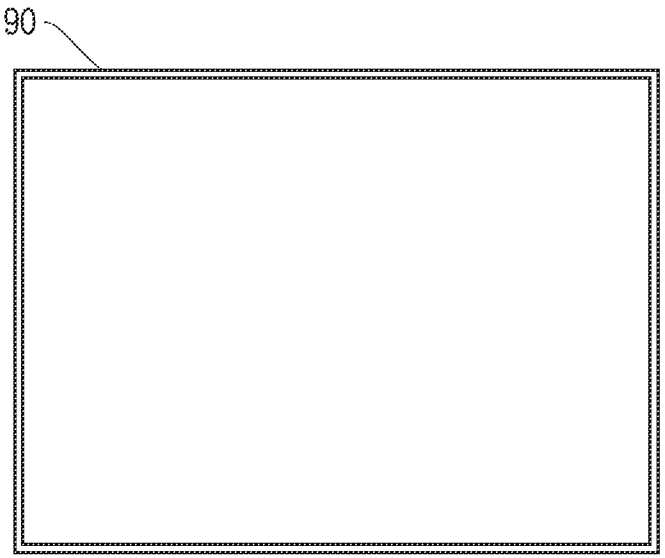
FIG. 3B is a top view of a rectangular-shaped hoop that may be used in a fourth embodiment of a decorative tree with connected hoops according to the present invention.
Figure 3A:
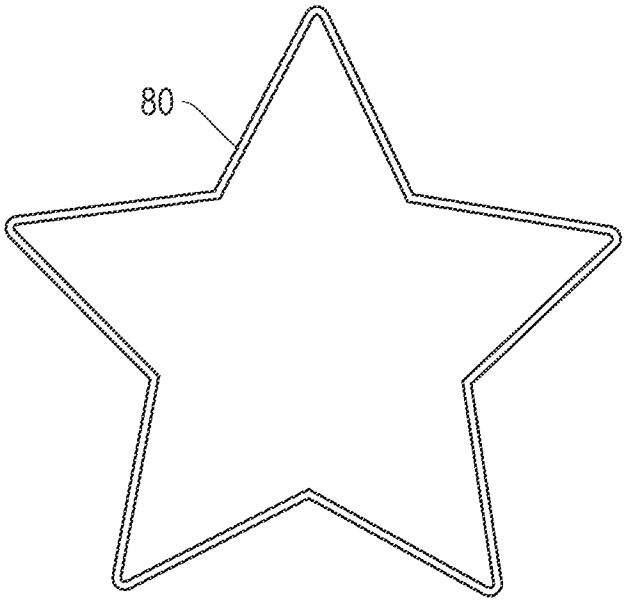
FIG. 3A is a top view of a star-shaped hoop that may be used in a third embodiment of a decorative tree with connected hoops according to the present invention.

Referring to FIG. 3A, in another embodiment, a decorative tree of the present invention may include one or more star-shaped hoops 80. The series of star-shaped hoops may be connected as in the first and second embodiments of FIGS. 1A and 2A such that a decorative tree comprising a series of star-shaped hoops may be constructed.

In another embodiment, shown in FIG. 3B, a decorative tree of the present invention may include one or more rectangular-shaped hoops 90. The series of rectangular-shaped hoops may be pivotably connected as in the first and second embodiments of FIGS. 1A and 2A such that a decorative tree comprising a series of rectangular-shaped hoops may be constructed.

Figure 3D:
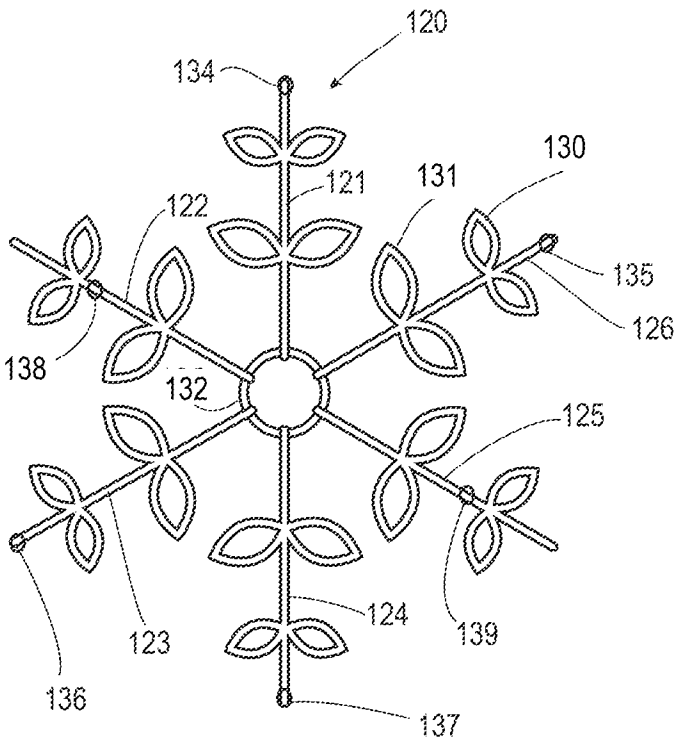
FIG. 3D is a top view of a second snowflake-shaped hoop that may be used in a sixth embodiment of a decorative tree with connected hoops according to the present invention.
Figure 3C:
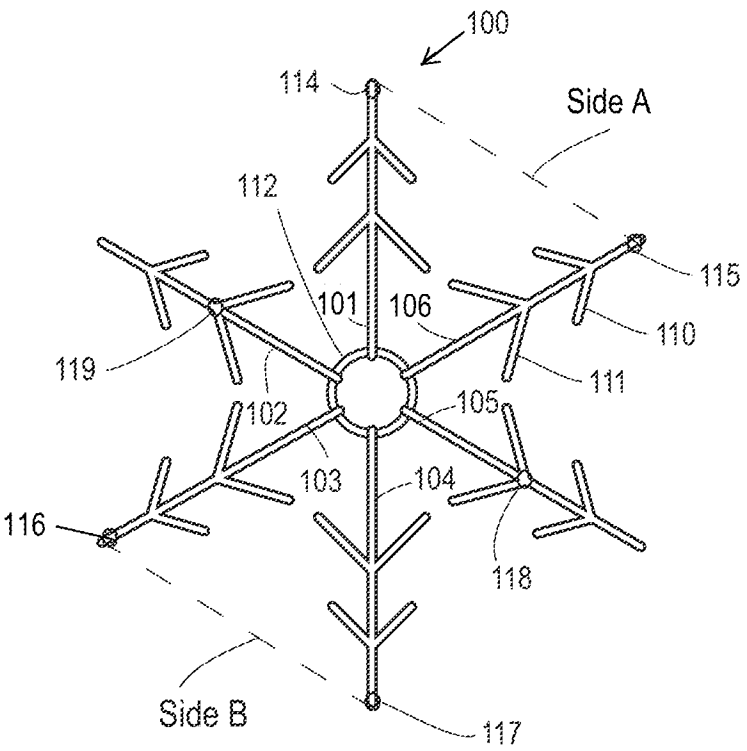
FIG. 3C is a top view of a first snowflake-shaped hoop that may be used in a fifth embodiment of a decorative tree with connected hoops according to the present invention.

In yet another embodiment, shown in FIG. 3C, a decorative tree of the present invention may include one or more snowflake-shaped hoops 100. The series of snowflake-shaped hoops 100 may be pivotably connected as in the first and second embodiments of FIGS. 1A and 2A such that a decorative tree comprising a series of snowflake-shaped hoops may be constructed. A decorative tree in accordance with this embodiment is shown as tree 150 and described below with reference to FIG. 5.

In the embodiment of FIG. 3C, hoop 100 comprises six branches 101 to 106 branching, in an approximately radially symmetric pattern, from a central hub 112. Central hub 112 is sized to have a sufficient diameter to provide clearance between the hub 112 and a central support tube 16 to maintain a position of each hoop relative to the central support tube and to enable the hoops 100 to move with ease up and down central support tube 16 during assembly and disassembly of the decorative tree. Each of branches 101 to 106 may include one or more pairs of approximately symmetrical, straight rods 110, 111 emanating therefrom in a pattern forming an outward-facing double arrow on each branch. However, the rods need not be substantially symmetrical. In this embodiment, it is desirable to have a hoop 100 pivotably connect to an adjacent hoop and to base 11 at a connection that has two connecting points 114, 115, one connecting point being located at or near the outer periphery or "edge", beyond the rods, on each of two adjacent branches 101, 106. These adjacent branches 101, 106 may be considered to form one of six "sides" (labeled "side A" but not forming a part of the snowflake design) of the snowflake. Each hoop 100 that is connected to an adjacent similarly-shaped hoop may also have two connecting points 116, 117, with one of the connecting points at the outer periphery, beyond the rods, on each of two adjacent branches 103, 104 on a side "B" of the snowflake pattern opposite to side "A." With two connecting points, adjacent snowflake-shaped hoops may rotatably pivot relative to one another along a single axis formed by a particular "side" of the hoop.

In the embodiment of FIG. 3C, monofilament lines 41, 42 may be attached to each snowflake-shaped hoop at, for example, points 118 and 119 around the inner arrow-shaped rods along branches 102 and 105. It has been found advantageous to position the monofilament lines 41, 42 in this configuration to substantially prevent entanglement of the lines during assembled or disassembly of the tree.

FIG. 3D shows a variation on the hoop shape of FIG. 3C. As in FIG. 3C, a decorative tree of the present invention may include one or more snowflake-shaped hoops 120 with six branches 121 to 126 approximately symmetrically arrayed around a center hub 132. Hub 132 is sized to have a sufficient diameter to provide clearance between the hub 132 and the central support tube 16 so that the hoops 120 may move with ease up and down central support tube 16 during assembly and disassembly of the decorative tree. However, in the embodiment of FIG. 3D, the branches of the snowflake each include one or more leaf-shaped protrusions 130, 131 rather than straight rods 110, 111.

A snowflake-shaped hoop 120 may be connected to an adjacent snowflake-shaped hoop 120 at a connection that comprises two connecting points 134, 135 on a side of the hoop toward the outer periphery (or "edge") of branches 121, 126, beyond protrusions 130, 131. For each hoop 120 that is connected to an adjacent similarly-shaped hoop 120, there may be two additional connecting points 136, 137, one on each of adjacent branches 123, 124 that form a side of the snowflake pattern opposite to the side formed by branches with connecting points 114, 115. Alternatively, it is possible to have a pivotable connection between adjacent hoops in which the connection comprises only a single connection point on each side. In this embodiment, monofilament lines 41, 42 may be attached along branches 122, 125 at points 138, 139.

Figure 4:
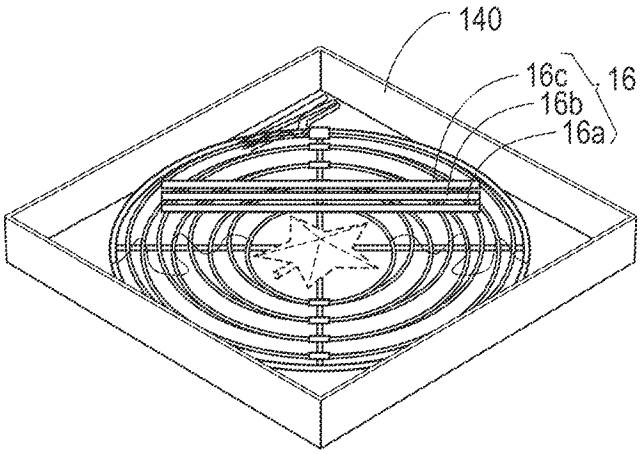
FIG. 4 is an isometric view of a preassembled/disassembled decorative tree stowed in a storage box according to the present invention.

The construction of the decorative tree of the present invention enables the tree to assume a compact orientation for storage. FIG. 4 is a view of an unassembled decorative tree compactly stowed in a storage box 140 according to the present invention.

The tree, e.g., tree 10 of FIG. 1A or tree 50 of FIG. 2A, may be disassembled by disconnecting the topmost hoop from the central support tube 16 and allowing the hoops to collapse upon one another. In the preferred embodiment, in which a hanger 17 is connected to the uppermost hoop and is removably inserted at the top of central support tube 16, hanger 17 can be removed from tube 16 to release the hoops and allow them to collapse. (In an embodiment, the lowermost hoop may be disconnectable from the base.) The central support tube 16 is then removed from the base 11 and, if made from several pieces, the pieces can be slid apart. Base 11, any lighting wrapped around the hoops, and tree topper 40 may also fit within box 140.

The storage configuration is relatively compact. If hoops having similar configurations but decreasing sizes from bottom to top are utilized, when the hoops are collapsed upon themselves, the topmost hoop will fit within the next hoop, which in turn will fit within the third hoop, the third hoop within the fourth hoop, and so forth. Thus, when in the storage configuration, the height of the decorative tree is barely greater than the thickness of the bottom hoop.

Alternatively, where the hoops are not sized to fit within one another for storage, nevertheless, compact storage can be achieved because the height of the vertical stack of hoops is substantially limited to the number of hoops times the thickness of each hoop.

Compact storage configuration is particularly advantageous since decorative trees are often used only on a seasonal basis and spend most of the time being stored. Compact storage is useful. Likewise, when the product is shipped to stores or purchased by a consumer, the compact storage configuration is convenient, making such product desirable.

Figure 5:
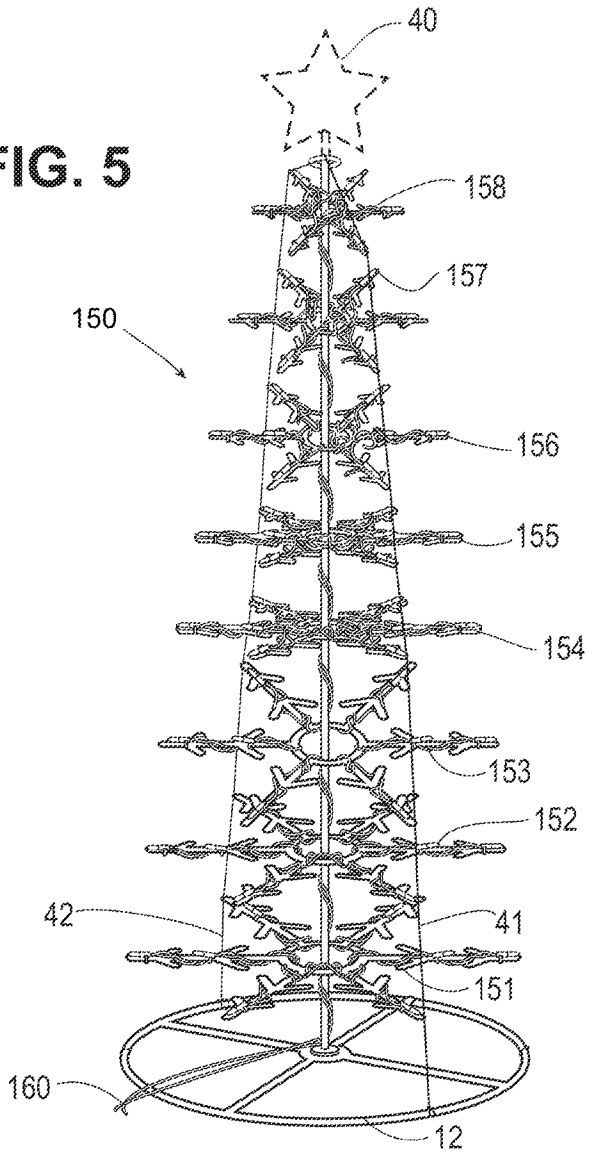
FIG. 5 is an isometric view of a decorative tree with the snowflake-shaped loops of FIG. 3C in which the hoops are wrapped in a string of lights according to the present invention.

FIG. 5 shows a third embodiment of a tree 150 according to the present invention. In this embodiment, tree 150 is formed of a series of hoops 151 to 158 that are each snowflake-shaped as depicted in FIG. 3C. In the illustrated embodiment, hoops 151, 152 and 153 are connected to one another with the types and possible locations of connections in this embodiment that are described above with respect to FIG. 3C. One skilled in the art will understand that hoops 154 to 158 may be connected similarly to the connections of hoops 151, 152 and 153.

However, in an embodiment of the present invention, shown in FIG. 5, hoops 154 to 158 are not shown as pivotably connected with one another. Rather, in the illustrated embodiment, hoops 154 to 158 may be secured to each other only with monofilament lines 41, 42 that are tied to hoops 154 to 158 at spaced intervals. One or more of hoops 154 to 158 could also be supported by retaining clips such as those shown in FIGS. 7A and 7B, and a retaining clip could be used to support one or more of hoops 151, 152 and 153.

In FIG. 5, the hoops of tree 140 are shown wrapped in light strings 160 starting at base 12 and upward through hoop 158 and optional tree topper 40. When illuminated with light strings 160 at night, the decorative tree 150 may give the appearance of a Christmas tree. Although only depicted with the tree of FIG. 5, one skilled in the art will understand that light strings may likewise be used in any embodiment of the present invention.

Figure 6B:
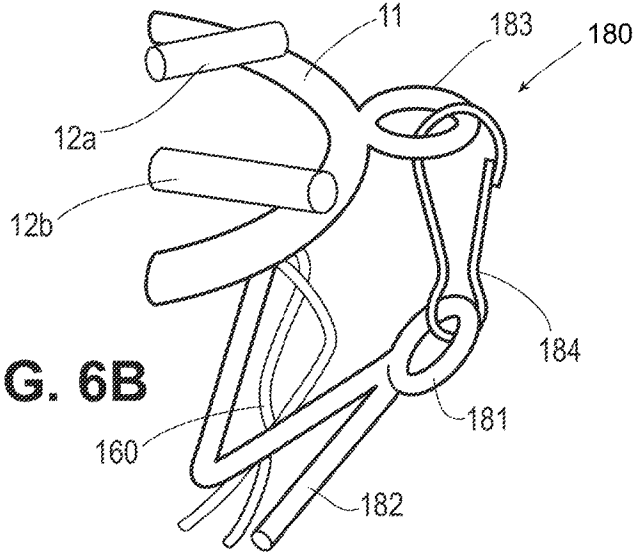
FIG. 6B is an enlarged view of a second embodiment of a connector that may be used in accordance with the present invention.
Figure 6C:
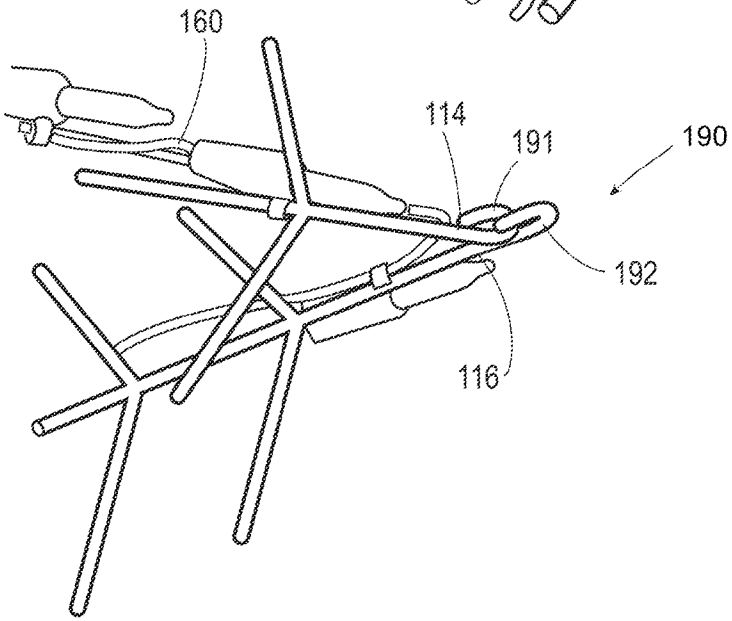
FIG. 6C is an enlarged view of a third embodiment of a connector that may be used in accordance with the present invention.
Figure 6A:
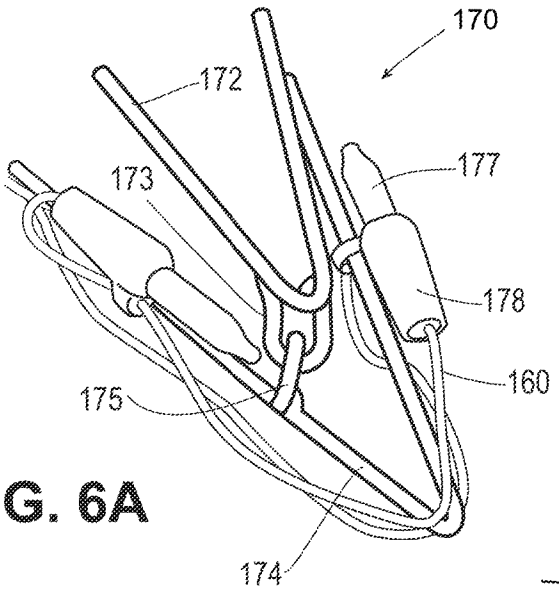
FIG. 6A is an enlarged view of a first embodiment of a connector that may be used in accordance with the present invention.

FIGS. 6A, 6B, and 6C respectively illustrate three different types of connectors that may be used at connecting points of the decorative tree of the present invention. As explained above, connecting points may be located at a connection between hoops, at a connection between the lowermost hoop and the tree base, and at a connection between the uppermost hoop and the top of the tree. The embodiments shown in these figures are provided as examples. However, other types of connectors may alternatively be used.

In FIG. 6A, the illustrated connecting point 170 comprises a first hoop 172 with a looped link 173 molded to hoop 172. The adjacent hoop, base or hub 174 has a pin 175 that fits within link 173 and limits the movement of hoop 172 relative to the adjacent hoop, base or hub 174. A light string 160 that is wrapped around decorative tree includes bulbs 177 in respective sockets 178.

In FIG. 6B, the illustrated connecting point 180 comprises a ring 181 formed on hoop 182, a ring 183 formed on adjacent base 12 (or on hanger 17) and a removable clip 184 that connects rings 181 and 183. FIG. 6B also illustrates light strings 160 wrapped around hoop 182.

FIG. 6C depicts another embodiment of a connecting point 190. In this embodiment, a loop 191 at connecting point 114 on one branch of a snowflake-shaped hoop 100 interlocks with another loop 192 at connecting point 116 of a branch of an adjacent, snowflake-shaped hoop.

Figure 7B:
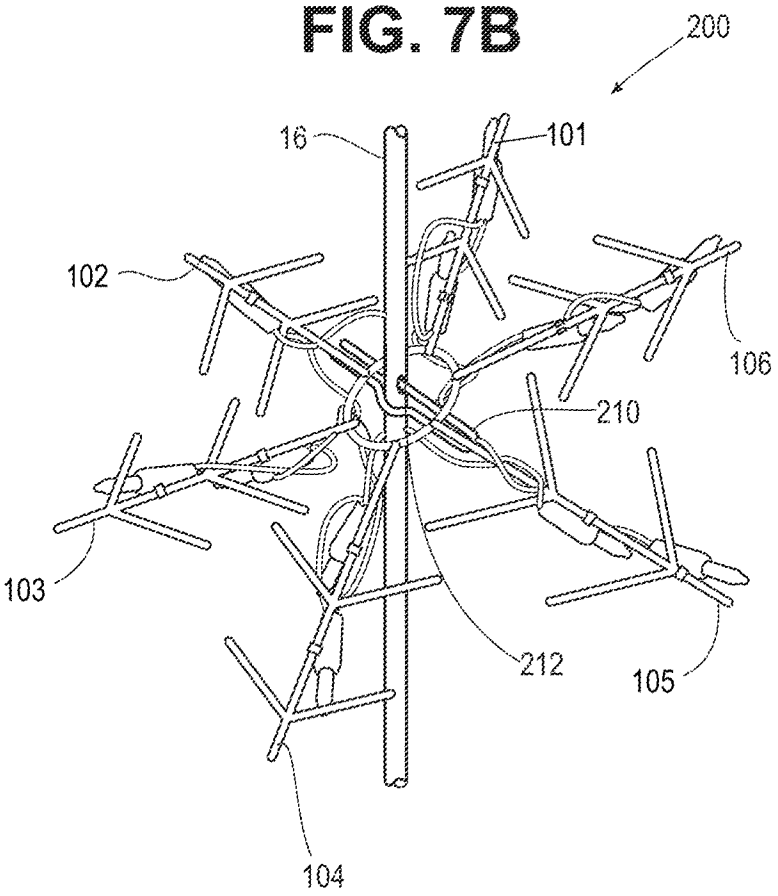
FIG. 7B is an isometric view of the hoop attached to the central support tube as shown in FIG. 7B.
Figure 7A:
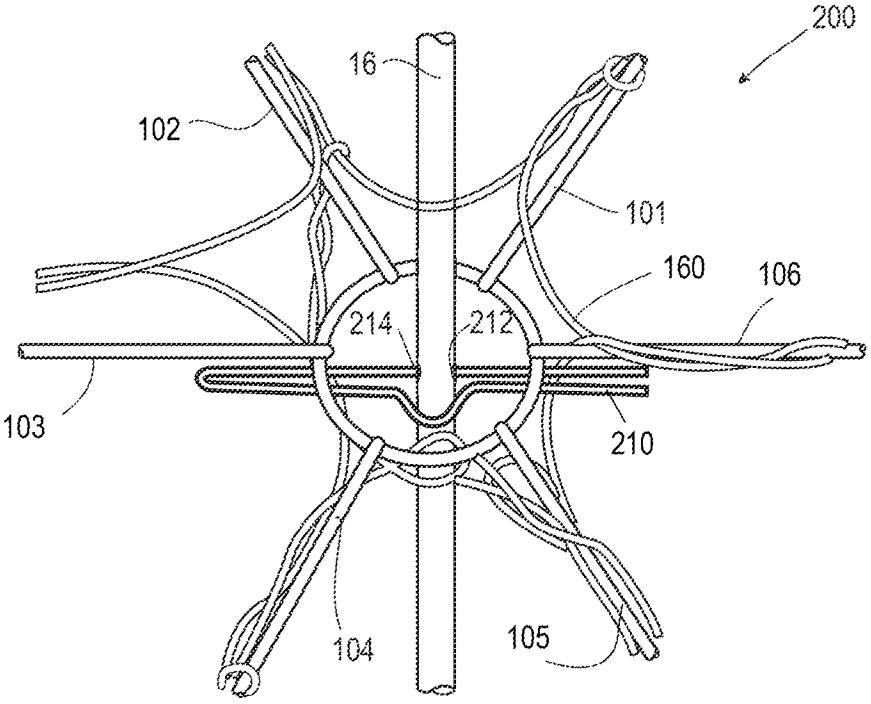
FIG. 7A is an isometric view of a single snowflake-shaped hoop held in a vertically-assembled position with a clip inserted through the central support tube of the decorative tree according to the present invention.

To further maintain the stability of the decorative tree according to the present invention, it may be advantageous to use a retaining clip under one or more of the hoops of the tree. This optional feature is illustrated in FIG. 7A. In FIG. 7A, a hoop 200 can be positioned above a minimum desired vertically-assembled position with the assistance of a removable retaining clip 210. In this embodiment, central support tube 16 of the decorative tree includes a pair of substantially horizontal positioning holes 212, 214 at a particular height. During assembly, after the series of hoops is extended from the base to the top hanger along central support tube 16, a removable clip 210 may be inserted through holes 212, 214 to maintain hoop 200 above the desired height. Clips 210 may be used for each hoop or just at one or more of the hoops of the tree. FIG. 7B shows an isometric view of the hoop 200 of FIG. 7A with the inserted retaining pin 210. During disassembly of the tree, the clip 210 must be removed.

Now that embodiments of the present invention have been shown and described in detail, various modifications and improvements thereon can become readily apparent to those skilled in the art. Accordingly, the exemplary embodiments of the present invention, as set forth above, are intended to be illustrative, not limiting. The spirit and scope of the present invention is to be construed broadly.

I claim:

1. A decorative tree comprising:

(A) a base;

(B) a central support tube comprising a first end for releasable attachment to the base and a second end toward a top of the tree upon assembly;

(C) a plurality of hoops connected in series and connectable to the central support tube at a first connection located toward the second end of the central support tube, the plurality of hoops comprising (i) a first hoop; and (ii) a second hoop connected to the first hoop at a second connection spaced from the first connection on the first hoop, wherein the first and second hoops are rotatable relative to one another about the second connection so that when the tree is completely assembled the first and second hoops extend downward with different angular orientations; and (D) a string attached toward the top of the central support tube and attached to one or more of the plurality of hoops to limit the motion of the hoops in the different angular orientations when the tree is completely assembled.

2. The decorative tree of claim 1, further comprising one or more independent hoops that are connected to the plurality of hoops with the string but are not connected in series with the plurality of hoops, wherein the one or more independent hoops are located intermediate the plurality of hoops and the central support tube.

3. The decorative tree of claim 1, wherein the base and the central support tube provide an upright structure for the tree upon assembly, and further comprising a lower hoop connected to or connectable to the upright structure at a third connection and connected to or connectable at a fourth connection to the plurality of hoops upon assembly.

4. The decorative tree of claim 1, wherein the string is further attached to the base of the tree or toward the first end of the central support tube of the tree to maintain the rigidity of the tree.

5. The decorative tree of claim 1, wherein the string is a monofilament line.

6. The decorative tree of claim 1, wherein the base and the central support tube provide an upright structure for the tree upon assembly, and wherein the second hoop is connected or connectable at a third connection to the upright structure of the tree.

7. The decorative tree of claim 1, wherein the base and the central support tube provide an upright structure for the tree upon assembly, and wherein one of the plurality of hoops is connected to the upright structure of the tree at a third connection when the tree is completely assembled.

8. The decorative tree of claim 1, wherein the plurality of hoops further comprises a third hoop connected to the second hoop at a third connection, wherein the third hoop is rotatable, about the third connection, relative to the second hoop during assembly so that, when the tree is completely assembled, the first, second, and third hoops extend downward from the first connection with alternating angular orientations.

9. The decorative tree of claim 1, further comprising one or more flexible light strings wrapped around one or more of the plurality of hoops to illuminate the tree.

10. The decorative tree of claim 1, wherein each of the plurality of hoops is a substantially planar object that fits around the central support tube with clearance to enable limited movement relative to the central support tube.

11. The decorative tree of claim 1, wherein one or more of the plurality of hoops has a particular shape selected from a group of shapes consisting of a circle, an oval, a triangle, a rectangle, a polygon, a star, a snowflake, and an animal shape.

12. The decorative tree of claim 1, wherein the plurality of hoops are substantially circular or oval, and wherein the plurality of hoops are successively larger in size starting from the first hoop downward, when the tree is completely assembled.

13. The decorative tree of claim 1, wherein the plurality of hoops are substantially circular or oval, and wherein the second connection is spaced from the first connection on the first hoop by substantially 180 degrees.

14. The decorative tree of claim 1, wherein each of the plurality of hoops is substantially triangular in shape, and wherein the plurality of hoops are successively larger in size starting from the first hoop downward, when the tree is completely assembled.

15. The decorative tree of claim 14, wherein the triangular-shaped hoops each have an apex and a base opposite the apex, and wherein the second connection of a triangular-shaped hoop to the adjacent triangular-shaped hoop is located proximate to the apex of the first hoop and the base of the second hoop.

16. The decorative tree of claim 15, wherein the triangular-shaped hoops are oriented in a relatively downward direction with the bases of each of the triangular-shaped hoops positioned higher than the respective apices of the triangular-shaped hoops.

17. The decorative tree of claim 1, wherein each of the plurality of hoops has a snowflake shape and comprises a center hub that maintains a position of each hoop relative to the central support tube, when the tree is completely assembled, and permits movement of the center hub during assembly and disassembly.

18. The decorative tree of claim 17, wherein each of the snowflake-shaped hoops further comprises a plurality of branches and wherein each of the first and second connections comprises two connecting points on each of two adjacent branches that define an axis about which a first of the snowflake-shaped hoops rotates relative to a second, adjacent snowflake-shaped hoop.

19. The decorative tree of claim 1, wherein the central support tube comprises positioning holes in proximity to and beneath at least one of the plurality of hoops, when the tree is completely assembled, and wherein the tree further comprises a pin to be releasably inserted into the positioning holes to maintain the at least one of the plurality of hoops above a particular vertical height along the central support tube, when the tree is completely assembled.

20. The decorative tree of claim 1, wherein the central support tube comprises multiple segments to be assembled.

21. The decorative tree of claim 1, wherein each the first and second hoops comprises a ring attached thereto and wherein the second connection comprises a clip that connects the rings on the first and second hoops.

22. A method of assembling a decorative tree comprising the steps of:

(A) providing the unassembled decorative tree of claim 1;

(B) securing the central support tube to the base;

(C) extending the plurality of hoops upward around the central support tube; and (D) connecting the first hoop toward the top of the central support tube.

23. A decorative tree comprising:

(A) a base;

(B) a central support tube comprising a first end for releasable attachment to the base and a second end toward a top of the tree upon assembly, wherein the base and the central support tube provide an upright structure for the tree upon assembly;

(C) a plurality of hoops comprising (i) an upper hoop connectable at a first connection located toward the second end of the central support tube, and (ii) one or more additional hoops connected in series to the upper hoop at a second connection; and (D) a lower hoop connected to or connectable to the upright structure at a third connection and connected to or connectable at a fourth connection to the one or more additional hoops upon assembly;

wherein at least one of the plurality of hoops is rotatable relative to an adjacent one of the plurality of hoops such that when the tree is completely assembled, the at least one of the plurality of hoops has a different angular orientation than the adjacent one of the plurality of hoops.

24. The decorative tree of claim 23, wherein the plurality of hoops extend vertically on the tree when the tree is assembled and form a pattern of alternating angular orientations.

25. The decorative tree of claim 23, further comprising one or more flexible light strings wrapped around one or more of the plurality of hoops to illuminate the tree.

26. The decorative tree of claim 23, wherein one or more of the plurality of hoops comprises a center hub that maintains a position of the one or more of the plurality of hoops relative to the central support tube, when the tree is completely assembled, and permits movement of the center hub during assembly and disassembly.

27. The decorative tree of claim 23, wherein the central support tube comprises positioning holes in proximity to and beneath at least one of the plurality of hoops, when the tree is completely assembled, and wherein the tree further comprises a pin to be releasably inserted into the positioning holes to maintain the at least one of the plurality of hoops above a particular vertical height along the central support tube, when the tree is completely assembled.

28. A decorative tree comprising:

(A) a base;

(B) a central support tube comprising a first end for releasable attachment to the base and a second end toward a top of the tree upon assembly, wherein the base and the central support tube provide an upright structure for the tree upon assembly;

(C) a plurality of hoops in series, wherein the plurality of hoops includes (i) a first hoop pivotably connectable at a first connection located toward the second end of the central support tube, and (ii) two or more additional hoops pivotably connected to each other at a second connection and connected at a third connection to the first hoop at a first end of the two or more additional hoops;

wherein, when the tree is completely assembled, the plurality of hoops extend downward from the first connection such that the plurality of hoops have alternating angular orientations; and (D) a string attached toward the top of the central support tube and attached to one or more of the plurality of hoops to limit the motion of the plurality of hoops when the tree is completely assembled.

29. The decorative tree of claim 28, wherein the string is a monofilament line that maintains the rigidity of the tree.

30. The decorative tree of claim 28, further comprising one or more flexible light strings wrapped around one or more of the plurality of hoops to illuminate the tree.

31. The decorative tree of claim 28, wherein one or more of the plurality of hoops comprises a center hub that maintains a position of the one or more of the plurality of hoops relative to the central support tube, when the tree is completely assembled, and permits movement of the center hub during assembly and disassembly.

32. The decorative tree of claim 28, wherein the central support tube comprises positioning holes in proximity to and beneath at least one of the plurality of hoops, when the tree is completely assembled, and wherein the tree further comprises a pin to be releasably inserted into the positioning holes to maintain the at least one of the plurality of hoops above a particular vertical height along the central support tube, when the tree is completely assembled.

33. A decorative tree comprising:

(A) a base;

(B) a central support tube comprising a first end for releasable attachment to the base and a second end toward a top of the tree upon assembly, wherein the base and the central support tube provide an upright structure for the tree upon assembly; and (C) a plurality of hoops in series, wherein the plurality of hoops comprises (i) a first hoop pivotably connectable at a first connection to the central support tube and located toward the second end of the central support tube, and (ii) a second hoop pivotably connected to the first hoop at a second connection spaced from the first connection on the first hoop, wherein the first and second connections permit the angular movement of the first and second hoops relative to one another such that when the tree is completely assembled the first and second hoops extend downward from the first connection with different angular orientations;

wherein one of the plurality of hoops is connected to the upright structure of the tree at a third connection when the tree is completely assembled.

* * * * *